US005960818A

United States Patent [19]

Hecking

[11] Patent Number: 5,960,818

[45] Date of Patent: Oct. 5, 1999

[54] FILLING FITTING FOR FILLING A CLOSED HOT-WATER HEATING SYSTEM

[75] Inventor: Willi Hecking, Mönchengladbach, Germany

[73] Assignee: Hans Sasserath & Co. KG, Korschenbroich, Germany

[21] Appl. No.: 09/149,075

[22] Filed: Sep. 8, 1998

[51] Int. Cl.[6] ..... E03C 1/10

[52] U.S. Cl. ..... 137/218; 137/614.2; 137/881

[58] Field of Search ..... 137/218, 614.2, 137/881

[56] References Cited

U.S. PATENT DOCUMENTS 5,215,121 6/1993 Michl ..... 137/614.2

*Primary Examiner*—Gerald A. Michalsky
*Attorney, Agent, or Firm*—McDermott, Will & Emery

[57] ABSTRACT

The invention relates to a filling fitting for filling a closed hot-water heating system, the filling fitting comprising a tube separator including an upstream backflow preventer, a downstream backflow preventer and a drain valve controlled by the inlet pressure and arranged, with regard to the flow, between said two backflow preventers, and a pressure reducer. This construction allows the downstream pressure reducer to be used in two manners, on one hand in connection with the tube separator and, on the other hand, in order to allow the pressure reducer to be removed. By dividing the filling fitting into two fitting portions, of which the second one only comprises the pressure reducer and the downstream backflow preventer, the second fitting portion can also be used alone without tube separator, when the safety requirements are less strict.

10 Claims, 1 Drawing Sheet

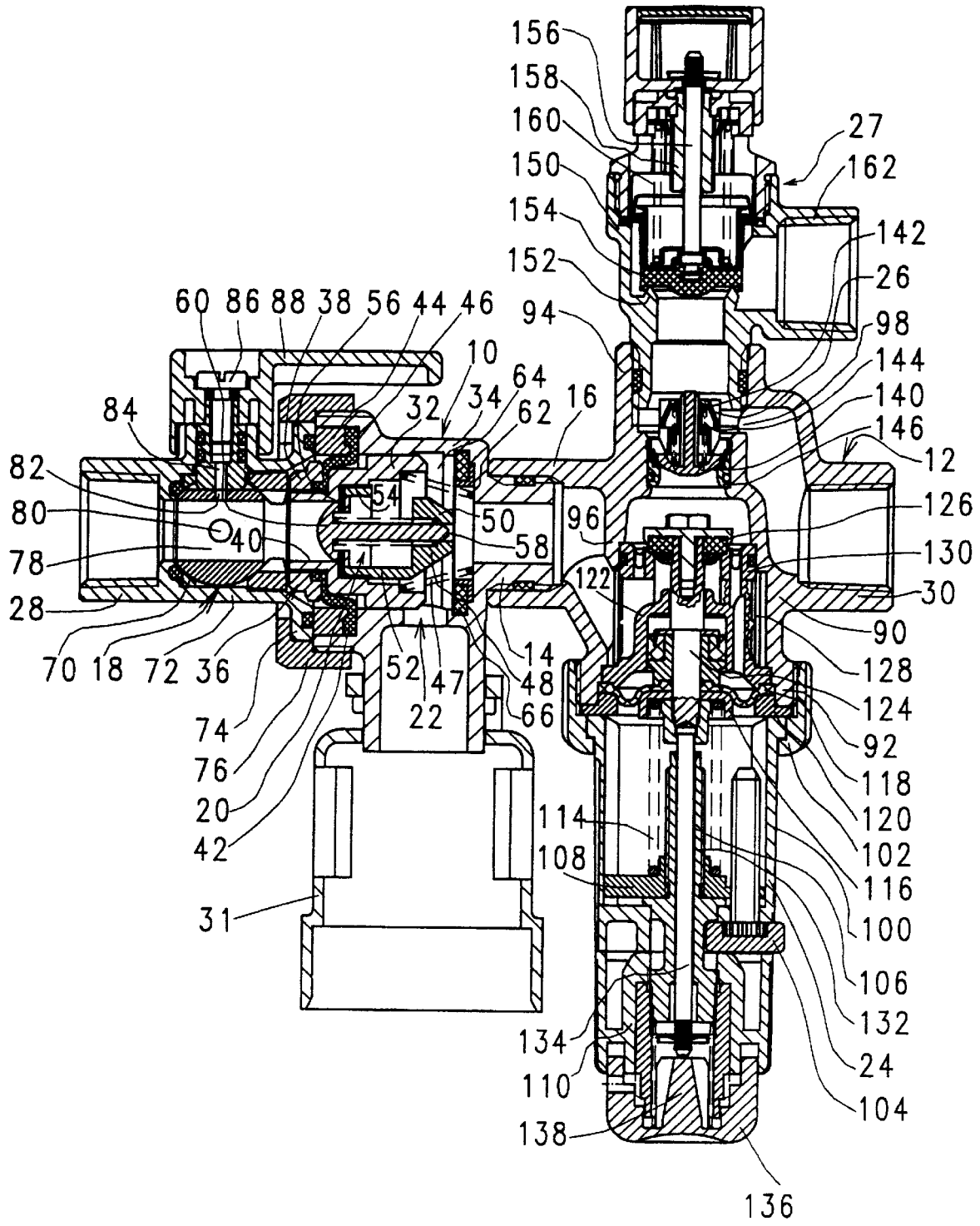
156
158
160
150
154
152
94
27
162
142
26
98
144
140
146
12
126
130
30
90
128
124
92
118
120
102
116
100
106
132
24
104
136
138
110
134
114
108
31
22
66
48
47
52
14
122
96
58
50
54
40
82
80
78
28
70
18
72
36
74
76
20
42
84
60
86
88
38
56
44
46
10
32
34
64
62
16

FILLING FITTING FOR FILLING A CLOSED HOT-WATER HEATING SYSTEM

BACKGROUND OF THE INVENTION

This invention relates to a filling fitting for filling a closed hot-water heating system, comprising: an inlet and an outlet to the heating system, a water path being defined between said inlet and said outlet, a tube separator including an upstream backflow preventer, a downstream backflow preventer and a drain valve controlled by the inlet pressure and arranged, with regard to the flow, between said two backflow preventers, and a pressure reducer.

Hot-water heating systems occasionally have to be refilled by water from the fresh water supply system. When refilling the system, it has to be ensured, that no heating water from the hot-water heating system flows into the fresh water supply system thereby contaminating the fresh water. Thus, it is not possible just to connect the hot-water heating system to a fresh water supply pipe through a stationary connection pipe having a shut-off valve. This could lead to the fact, that heating water flows back from the hot-water heating system into the fresh water supply system if, for example, the shut-off valve is open and the pressure in the fresh water supply system for some reason drops strongly. In order to prevent this, "backflow preventers" are provided in the water path between the hot-water heating system and the fresh water supply system. Backflow preventers are spring-loaded check valves adapted to open in the filling direction. When the system is filled these backflow preventers open under the action of the inlet pressure of the fresh water supply system and allow water to flow into the hot-water heating system. However, the backflow preventers close when the inlet pressure drops below the pressure in the hot-water heating system. Thus, they prevent backflow of heating water into the fresh water supply system.

Such backflow preventers may occasionally leak. That is why in some countries a stationary connection between fresh water supply system and hot-water heating system is not allowed even if a backflow preventer is provided. The connection has to be removed, after the system has been filled. This can be done in that filling or refilling of the hot-water heating system can be effected only through a hose which is removed after the filling. This is cumbersome. Furthermore, it is not ensured, that the hose actually is removed after the filling and the connection to the fresh water supply system has actually been removed. For this reason, "tube separators" are used. Such tube separators include an upstream backflow preventer, a downstream backflow preventer and a drain valve controlled by the inlet pressure and arranged, with regard to the flow, between the two backflow preventers. In such tube separators the drain valve usually consists of a tube connecting element located in the water path between the inlet and the outlet to the system, the tube connecting element being movable against a restoring force by an actuator piston exposed to the inlet pressure from an open position, in which the water path is interrupted and open toward a drain, to a closed position, in which the tube connecting element closes the water path. A shut-off valve is connected upstream from the tube separator. The tube separator and the shut-off valve are permanently installed. When the shut-off valve is closed in the normal state, the inlet pressure does not act on the actuator piston. The tube connecting element is retracted toward the inlet side closing the water path. Thus, it is ensured, that heating water cannot flow into the fresh water supply system if, for example, the shut-off valve unintentionally is kept open or the backflow preventer leaks. The downstream backflow preventer prevents the hot-water heating system from being drained. Heating water flowing out of the hot-water heating system when the downstream backflow preventer leaks flows into the drain. When the shut-off valve is opened in order to refill the hot-water heating system, the inlet pressure acts on the actuator piston. Thus, the tube connecting element is advanced and closes the water path to the hot-water heating system. During this procedure the upstream backflow preventer still is in the closed position. The upstream backflow preventer does not open until a further pressure rise occurs, after the tube connecting element has engaged a stop and has closed the water path.

In order to prevent inadmissibly high pressure in the hot-water heating system, which could be caused by high pressure in the fresh water supply system, a pressure reducer is inserted in prior art filling fittings between the connection to the fresh water supply system and the hot-water heating system. Such a pressure reducer comprises a control valve in the water path. The control valve is controlled by a diaphragm, on which the system pressure acts against the action of a spring. Normally, provision is made to temporarily disable the control function of the pressure reducer, when the hot-water heating system is being filled. In order to allow maintenance of the pressure reducer, usually a further shut-off valve is connected downstream from the pressure reducer, by means of which the connection between pressure reducer and hot-water heating system can be shut off by hand.

SUMMARY OF THE INVENTION

The object of the present invention is to construct in a simple manner a filling fitting for filling and refilling a closed hot-water heating system, which fitting has the function of tube seperator, backflow preventer and pressure reducer.

Another object of the invention is to provide a two-part filling fitting for filling and refilling a closed hot-water heating system, which fitting is divided in such manner, that the use of both fitting portions fulfills high requirements concerning the safety with regard to backflow as they are made in some countries, and, however, one of the fitting portions can be used alone as an operative filling fitting when the requirements concerning the safety with regard to backflow are lower.

These and other objects are achieved by a filling fitting of the type mentioned above in that the downstream backflow preventer of the tube separator is arranged downstream from said pressure reducer.

In such an arrangement, the downstream backflow preventer simultaneously fulfills two functions: It prevents the hot-water heating system from being drained when the drain valve is open. Furthermore, it enables removal of the pressure reducer for maintenance after the connection to the fresh water pipe has been shut off by means of a shut-off valve necessarily provided. The downstream backflow preventer thus separates the pressure reducer from the hot-water heating system.

With this construction, the filling fitting may be constructed having two portions, a first upstream fitting portion comprising the upstream backflow preventer and the drain valve and a second downstream fitting portion comprising the pressure reducer and the downstream backflow preventer. In this case, the second fitting portion can be use alone, when a tube separator is not required and the function of which can be effected by a single backflow preventer.

Further objects and features of the invention will be apparent to a person skilled in the art from the following specification of a preferred embodiment when read in conjunction with the appended claims.

BRIEF DESCRIPTION OF THE DRAWING

The invention and its mode of operation will be more clearly understood from the following detailed description when read with the appended drawing, in which a section through a two-part filling fitting for filling a closed hot-water heating system is illustrated.

DESCRIPTION OF THE PREFERRED EMBODIMENT

The filling fitting consists of a first upstream fitting portion 10 an a second downstream fitting portion 12. The two fitting portions 10 and 12 are interconnected through two connection sockets 14 and 16 screwed together. The first fitting portion 10 comprises an integrated shut-off valve 18, an upstream backflow preventer 20 and a drain valve 22. The second fitting portion 12 comprises a pressure reducer 24, a downstream backflow preventer 26 arranged downstream from the pressure reducer 24 and a relief valve 27 arranged downstream from the backflow preventer 26. An inlet socket 28 is adapted to be connected to a fresh water pipe of a fresh water supply system. An outlet socket 30 is adapted to be connected to a closed hot-water heating system. A water path extends from the inlet socket 28 to the outlet socket 30 through the filling fitting. The water path can be interrupted by the drain valve 22 and be connected to a drain 31.

The inlet socket 28, the connection sockets 14 and 16 and the outlet socket are arranged coaxially with each other. The drain 31 extends downwards with its axis being perpendicular to the axis of the inlet socket 18 and the connection socket 14 of the first fitting portion 10. The pressure reducer 24 extends downwards with its axis being perpendicular to the axis of the connection socket 16 and the outlet socket 30 of the second fitting portion 12. The relief valve 27 extends upwards coaxially with the pressure reducer 24 of the second fitting portion 12.

The drain valve 22 of the tube separator comprises a tube connecting element 32. The tube connecting element 32 is longitudinally movable in a housing portion 34 of the fitting portion 10. An actuator piston 36 is located at the tube connecting element 32. The actuator piston 36 has an annular body 38, which is located at a collar 40 of the tube connecting element 32, which collar 40 is integral with the end face of the tube connecting element 32. A diaphragm 42 is clamped with its inner edge between the annular body 38 and the end face of the tube connecting element 32. The outer edge of the diaphragm 42 is clamped between a clamping ring 44 and an annular shoulder 46 of the housing portion 34. The tube connecting element 32 is exposed to a spring 47. The spring 47 tends to push the tube connecting element 32 to the left in the FIGURE.

The upstream backflow preventer 20 formed as cartridge is located in the bore of the tube connecting element 32. The backflow preventer 20 comprises a cage 48 having a guiding body 50 and a ring 54 connected to the guiding body 50 through three longitudinal stays 52. The ring 54 is held stationary in the bore of the tube connecting element 32, an annular sealing washer 56 being interposed. A mushroom-shaped valve closing body 60 is guided with its shaft in a central longitudinal bore 58 of the guiding body 50. The valve closing body 60 is exposed to the spring 62. The spring 62 pushes the valve closing body 60 to the left in the FIGURE into engagement with the sealing washer 56. The sealing washer 56 acts as sealing lip.

When the connection to the fresh water supply system in interrupted by the shut-off valve 18, the spring 42 keeps the tube connecting element 32 in the left end position illustrated in the FIGURE. This interrupts the water path through an annular slot 64 between the right end face of the tube connecting element 32 in the FIGURE and an annular sealing washer 66 located in the housing portion 34 and surrounding the bore of the connection socket 14. The annular slot 64 communicates with the drain 31. The backflow preventer 20 is closed. When the shut-off valve 18 is opened in order to fill or refill the hot-water heating system, the inlet pressure acts on the annular body 38 and the diaphragm 42 as well as on the front face of the valve closing body 60. Thereby, the tube connecting element 32 is displaced to the right in the FIGURE against the action of the spring 47 until it engages the sealing washer 66. During this movement, the spring 62 keeps the backflow preventer 20 closed, that means it keeps the valve closing body 60 in engagement with the sealing washer. When the tube connecting element 32 engages the sealing washer 56, the water path is closed. The valve seat of the backflow preventer 20 formed by the sealing washer 56 does not move further to the right in the FIGURE. Then, under the action of the inlet pressure, the valve closing body 60 lifts off from the sealing disc 56 against the action of the spring 62. The backflow preventer 20 opens.

The shut-off valve 18 is a ball valve having a globular cock plug 70. The ball valve 18 is located at a valve housing 72. The valve housing 72 is tubular having a flange 74. The flange 74 is covered by a cap nut 76, which is screwed on the housing portion 34. The ring 44 and the outer edge of the diaphragm 42 are held between the flange 74 and the annular shoulder 46. The valve housing 72 forms the inlet socket 28 and has a straight through-passage governed by the shut-off valve 18, which through-passage is aligned with the bore of the housing portion 32 and communicates therewith.

The valve plug 70 of the shut-off valve 18 shown in its open position in the FIGURE has a through-bore 78. A check bore 80 extends toward one side transversely to the through-bore and to the axis of rotation of the valve plug 70. Furthermore, the valve plug 70 has a bore 82 extending along the axis of rotation and communicating with a housing-fixed bore 84. The bore 84 is sealingly closed by a screw 86. The valve plug can be rotated by a handle 88.

In the illustrated position the shut-off valve is open. If the handle 88 is rotated to the front out of the paper plane of the FIGURE by 90°, then the through-passage is closed to the inlet side. However, from the side of the backflow preventer 20, the through-bore communicates through the check bore 80 and the bore 82 with the bore 84. After the screw has been removed, the closeness of the backflow preventer 20 can be proven.

The second fitting portion 12 has a housing portion 90. The housing portion 90 is provided, mutually angularly offset by 90°, with the connection socket 16, an accommodation socket 92, the outlet socket 30 and an accommodation socket 94. A tubular wall portion 96 aligned with the accommodation socket 92 is formed in the housing portion 90. A passage 98 is formed between the wall portion 96 and the accommodation socket 94, through which passage 98 the interior of the wall portion 96 communicates with the outlet socket 30. The water path extends in the second fitting portion 12 from the connection socket 16 about the lower end of the wall portion 96 in the FIGURE, through the interior of the wall portion 96 and through the passage 98 to the outlet socket 30.

The pressure reducer 24 is inserted into the accommodation socket 96.

The pressure reducer 24 has a spring housing 100 having a flange along its edge. The spring housing 100 is connected to the accommodation socket 92 of the housing portion 90 by means of a cap nut 102. The cap nut 102 extends over the flange. The cap nut 102 allows the spring housing 100 to be rotated, such that an indicator wheel is comfortably visible. A spring plate 108 is non-rotatably guided on an adjusting spindle 106. An adjusting handle 110 is located at the adjusting spindle 106. The adjusting spindle 106 can be rotated by means of the adjusting handle 110.

A biased load spring 114 engages the spring plate 108. The load spring 114 urges against a diaphragm plate 116 of a diaphragm 118, which is clamped between a ring 120 held in the connection socket 92 through the cap nut 102 and an intermediate housing 122. A valve tappet 124 of a pressure reducer valve body 126 is connected to the diaphragm 188, such that the diaphragm 118 moves the pressure reducer valve body 126. By rotating the adjusting handle 110 and, thus, the adjusting spindle 106 the spring plate 108 is moved axially. This varies the bias of the load spring 114. The indicator wheel is connected to the spring plate 108, such that the position of the spring plate 108 can be read at the indicator wheel 104 as a measure of the bias of the load spring 114. The pressure reducer valve body 126 cooperates with a valve seat 130. The valve tappet 124 extends through the valve seat 130, such that the pressure reducer valve body 126 is arranged downstream from the valve seat 130.

The pressure in the hot-water heating system acts on the side of the diaphragm 118 remote from the diaphragm 116. If this pressure is higher than the pressure set by the adjusting handle 110, the diaphragm 118 moves upwards in the FIGURE and, thus, closes the pressure reducer valve 126, 130 through the valve tappet 124. The pressure reducer valve 126, 130 governs the passage from the connection socket 16 to the interior of the tubular wall portion 96.

A cylindrical filter 128 is integrated in the pressure reducer 24 and covers the passage from the connection socket 16 to the valve seat 130.

The pressure reducer 24 forms an exchangeable cartridge-like unit which, together with the valve seat 130, is inserted into the accommodation socket 92, the valve seat 130 engaging the end face of the tubular wall portion 96. The thus inserted pressure reducer is then attached by means of the cap nut 102.

In the described filling fitting, a tappet 134 is movably guided in a central guiding sleeve 132 located at the spring plate 108. The tappet 134 is connected to the valve tappet 124. A knob 136 is longitudinally movably guided on the adjusting handle 110. The tappet 134 can be pressed down by hand through the knob through a thrust piece 138 of the tappet 134, such that it opens the pressure reducer valve 126, 130 through the valve tappet 124. Thus, the pressure reducing function can be disabled when the hot-water heating system is being filled.

The downstream backflow preventer 26 is located upstream from the passage 98 in the interior of the tubular wall portion 96. This backflow preventer 26 is constructed in a cartridge-like manner similar to the upstream backflow preventer 20. It comprises a mushroom-shaped valve closing body 140, which is guided with a shaft in a guiding body 142 and engages a valve seat 146 under the action of a spring 144.

The relief valve 27 is located in the accommodation socket 94. The relief valve has a housing 150. The housing 150 forms a valve seat 152. A valve disc 154 is located at the valve seat 152. The valve disc 154 is guided with a tappet 156 in a guiding sleeve 158. The valve disc 154 is loaded by a spring 160. When the force exerted on the valve disc 154 by the pressure in the hot-water heating system overcomes the bias of the spring 160, the relief valve 27 opens and drains water through a drain 162. The construction and the function of such relief valves are known per se and, therefore, is not described in detail herein. The relief valve 27 is located downstream from the downstream backflow preventer 26 and communicates through the passage 98 and the outlet socket 30 of the filling fitting directly with the hot-water heating system, without further control or shut-off members being provided therebetween.

The described filling fitting operates as follows:

When the shut-off valve is open, the tube connecting element 32 is brought in the described manner by the inlet pressure into its operating position, in which it closes the water path. Fresh water then flows in the first fitting portion 10 from the inlet socket 28 through the shut-off valve 18, the upstream backflow preventer 20 and the tube connecting element 32 to the connection socket 14. In the second fitting portion the fresh water then flows further from the connection socket 16 through the filter 128, the pressure reducer valve 126, 130, the interior of the tubular wall portion 96, the downstream backflow preventer 26 and the passage 98 to the outlet socket 30, which communicates with the closed hot-water heating system. When the system is refilled, the pressure reducer 24 is operative and limits the filling pressure. When a hot-water heating system originally empty is to be filled, the function of the pressure reducer 24 can be disabled by the knob 136 as described.

When the inlet pressure for some reason breaks down, when the shut-off valve 18 is open, and drops below the pressure of the heating water in the hot-water heating system, then backflow of heating water into the fresh water supply system is prevented by the backflow preventers 20 and 26. However, the spring 47 simultaneously urges the tube connecting element 34 to the left in the FIGURE and interrupts the water path with the slot 64. The effect is the same as the removal of a filing hose. Normally however, the heating system is not drained because the downstream backflow preventer 26 closes. If the backflow preventer 26 leaks, then the heating water flowing out does not flow into the fresh water supply system, but through the slot 64 into the drain 31.

The downstream backflow preventer 26 constitutes an essential member of the tube separator by preventing the hot-water heating system from being drained, when the drain valve 22 is opened and the tube connecting element 34 is retracted. This is the reason why the downstream backflow preventer in conventional tube separators is combined together with the tube connecting element and the upstream backflow preventer to a unit. In the arrangement described herein however, the downstream backflow preventer 26 is located in a second fitting portion 12 downstream from the pressure reducer 24. Thus, the downstream backflow preventer 26 additionally can fulfill a second function. It allows the pressure reducer 24 to be removed for maintenance or exchange after the shut-off valve 18 has been closed, whereby the hot-water heating system is prevented from being drained and without need for additional shut-off members as usual in the prior art.

The described arrangement has a further advantage: The second fitting portion 12 having the pressure reducer 24 and the backflow preventer can be used alone, when the safety requirements are less strict. In this case the connection socket 16 communicates with the fresh water supply system through some shut-off valve. The outlet socket communicates with the hot-water heating system. Backflow of heating water is then prevented by the backflow preventer 26 only. As in the illustrated embodiment, the backflow preventer 26 allows the pressure reducer 24 to be removed after the upstream shut-off valve has been closed. Thus, one and the same unit can be used for different purposes. The filling fitting is just provided with an absolutely necessary number of members, in particular shut-off members.

I claim:

1. A filling fitting for filling a closed hot-water heating system, comprising:

an inlet and an outlet to the heating system, a water path being defined between said inlet and said outlet, a tube separator including an upstream backflow preventer, a downstream backflow preventer and a drain valve controlled by the inlet pressure and arranged, with regard to the flow, between said two backflow preventers, and a pressure reducer, wherein said downstream backflow preventer of said tube separator is arranged downstream from said pressure reducer.

2. The filling fitting of claim 1, wherein said filling fitting has a first fitting portion and a second fitting portion, said upstream backflow preventer and said drain valve are arranged in said first fitting portion, said downstream backflow preventer is arranged in said second fitting portion, an accommodation socket provided to detachably accommodate said pressure reducer is provided at said second fitting portion downstream from said downstream backflow preventer, and said first and said second fitting portions are separably interconnected through connecting means located between said pressure reducer and said drain valve.

3. The filling fitting of claim 2, wherein said first fitting portion comprises a shut-off valve located upstream from said upstream backflow preventer.

4. The filling fitting of claim 2, wherein said connecting means consist of a pair of connection sockets extending into each other.

5. The filling fitting of claim 2, wherein said second fitting portion has a housing portion and a first accommodation socket at said housing portion for accommodating a pressure reducer constructed as an exchangeable unit, said housing portion has an inner tubular wall portion aligned with said first accommodation socket and ending at a distance from said first accommodation socket, and said pressure reducer has a valve seat and said wall portion has an end face, said valve seat being located on said end face.

6. The filling fitting of claim 5, wherein said downstream backflow preventer is arranged inside said tubular wall portion.

7. The filling fitting of claim 6, wherein said housing portion of said second fitting portion forms four sockets being mutually angularly offset by 90°, a first socket being said connection socket to said first fitting portion, a second socket being the accommodation socket for said pressure reducer, a third socket being an outlet socket to be connected to said hot-water heating system, and a fourth socket being an accommodation socket for a relief valve, said connection socket being arranged coaxially with said outlet socket and said accommodation socket for said pressure reducer being arranged coaxially with said accommodation socket for said relief valve, and said tubular wall portion has a passage between said downstream backflow preventer and said accommodation socket for said relief valve, said passage providing communication with said outlet socket such that said relief valve directly communicates with said outlet socket.

8. The filling fitting of claim 5, wherein said pressure reducer has a control valve arranged to be pushed by hand into an open position through a knob and a tappet, for fast filling said hot-water heating system.

9. The filling fitting of claim 1, wherein said drain valve is formed by a tube connecting element located in said water path between said inlet and said outlet, said filling fitting has a drain, said tube connecting element having an open position, in which said water path is interrupted and open toward said drain, and a closing position, in which said tube connecting element closes said water path, and an actuator piston exposed to the inlet pressure, said actuator piston being arranged to move said tube connecting element from said open position to said closing position against a restoring force.

10. The filling fitting of claim 9, wherein said tube connecting element has a passage, and said upstream backflow preventer is located in said tube connecting element and governs said passage, said upstream backflow preventer being dimensioned not to open under the action of an inlet pressure until said tube connecting element has been moved by said actuator piston to its closing position, in which said water path is closed.

* * * * *